US006484363B1

(12) United States Patent
Chung

(10) Patent No.: US 6,484,363 B1
(45) Date of Patent: Nov. 26, 2002

(54) ADJUSTABLE HINGE

(76) Inventor: Stanley Chung, 5430 Shannon Ridge La., San Diego, CA (US) 92130

( * ) Notice: Subject to any disclaimer, the term of this patent is extended or adjusted under 35 U.S.C. 154(b) by 71 days.

(21) Appl. No.: 09/777,507

(22) Filed: Feb. 5, 2001

(51) Int. Cl.[7] ..... F05D 7/04

(52) U.S. Cl. ..... 16/242; 16/241; 16/235; 16/DIG. 34

(58) Field of Search ..... 16/241, 242, 235, 16/DIG. 34

(56) References Cited

U.S. PATENT DOCUMENTS 583,512 A * 6/1897 Sexton
1,094,136 A * 4/1914 Donohue
1,345,524 A * 7/1920 Way
1,484,536 A * 2/1924 Way
1,540,581 A * 6/1925 Way
1,900,081 A * 3/1933 Swerer
1,908,383 A * 5/1933 Vice
2,533,502 A * 12/1950 Philips
2,724,144 A * 11/1955 Lohrman
5,491,873 A * 2/1996 Ferguson ..... 16/245
5,689,855 A * 11/1997 Tang ..... 16/235
5,964,012 A * 10/1999 Vigreux ..... 16/241
6,397,432 B1 * 6/2002 di Vinadio ..... 16/242

FOREIGN PATENT DOCUMENTS

DE 3504921 A1 * 8/1986
EP 0460620 A2 * 12/1991

* cited by examiner

*Primary Examiner*—Anthony Knight
*Assistant Examiner*—Alison K. Pickard
(74) *Attorney, Agent, or Firm*—Donn K. Harms

(57) ABSTRACT

An adjustable two piece hinge having a first hinge member for attachment to a wall surface and a second hinge member attachable to a door. The device is adjustable by rotating the hinge pin which communicates thorough two off-center cooperating apertures communicating axially through two body bushings located inside the second hinge member. Rotating the hinge pin rotates the circular body bushings inside the second hinge member thereby translating the second hinge member around the center axis of said first hinge member and toward and away from the first hinge member due to the eccentric formed by the off center apertures inside of a circular bushing. The device can optionally be supplied with a kit featuring a plurality of different body bushings having the off center apertures a different distance off center.

7 Claims, 1 Drawing Sheet

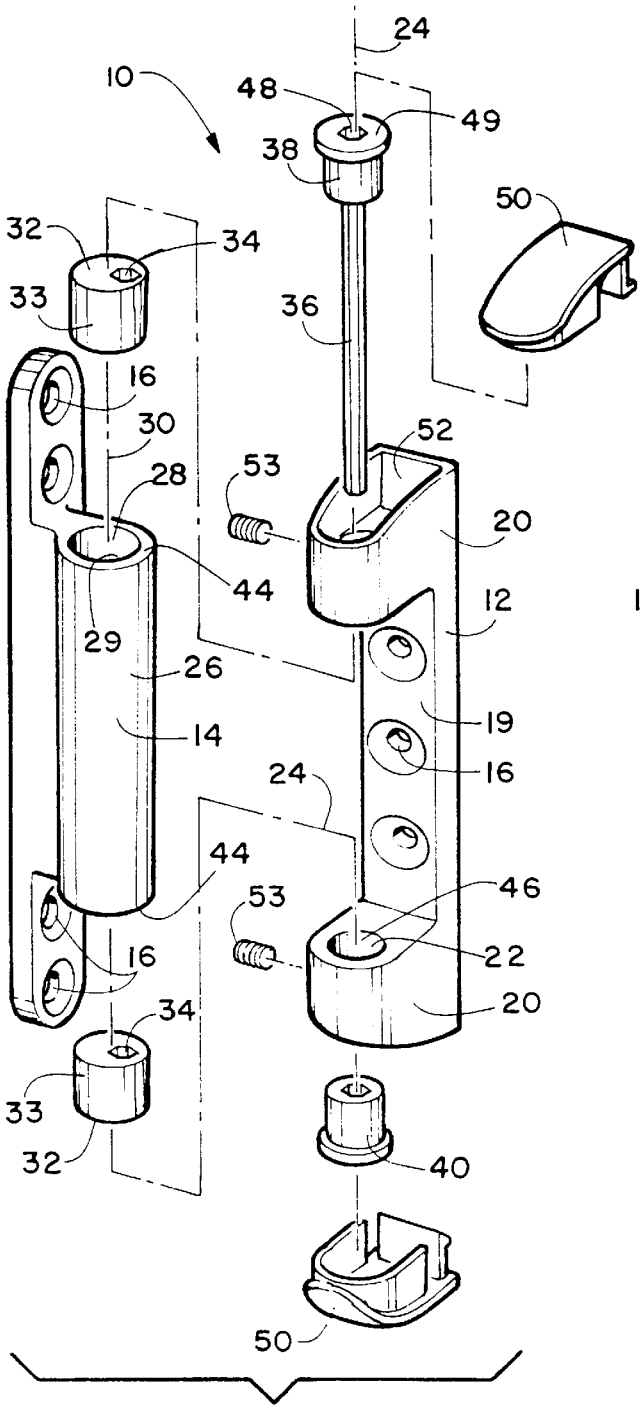
FIGURE 1
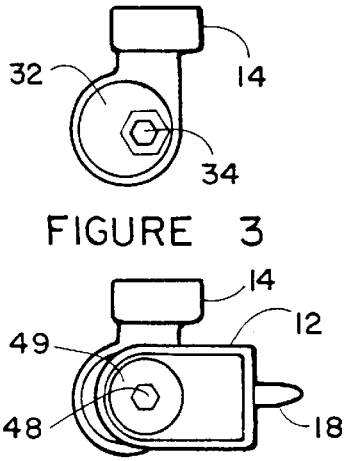
FIGURE 3
FIGURE 2
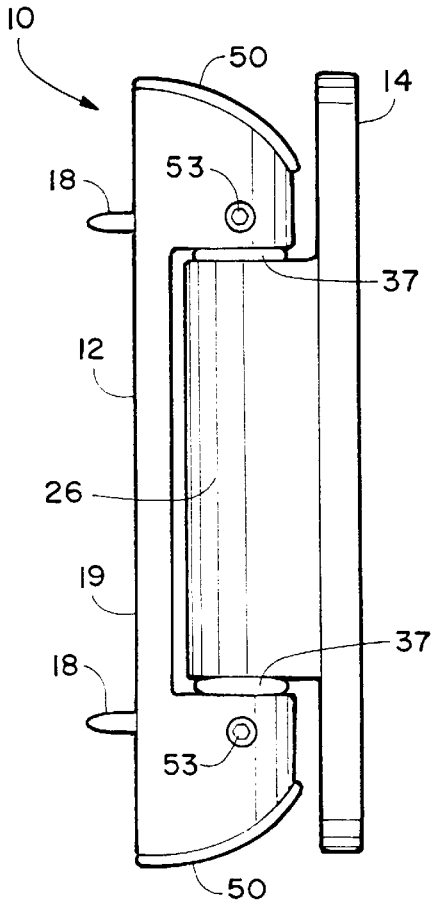
FIGURE 4

ADJUSTABLE HINGE

BACKGROUND OF THE INVENTION

1. Field of the Invention

The present invention relates to hinges for mounting and support of doors pivoting thereon. More particularly it relates to a hinge having first and second cooperatively engageable hinge members engaged by a hinge pin communicating therebetween. The engagement of the hinge members is adjustable to allow for lateral translation of the door mounted hinge member on its axis mount with the sash mounted hinge pin to allow for adjustment of the door attached thereto for the best engagement of the door inside the frame. Adjustment is provided by a pair of eccentric bushings cooperatively engaged with the door mounted hinge member through which the hinge pin communicates. Rotation of the end of the hinge member thereby rotates the eccentric bushings in their mount with the door mounted hinge member thereby laterally translating and excentricly moving the door mounted hinge member toward or away from the vertical edge of the door frame mounted hinge member thereby allowing the door to be adjusted for the best fit within the frame.

2. Prior Art

Aged door installations and new hung doors may tend to bind or sag a bit inside the doorjamb or frame surrounding the perimeter of the swinging door, due to a jamb being out of plumb. Or, the jam may be caused from friction between the door edge and surrounding frame from accidentally making the hinge mortise too deep which creates an uneven gap between the door and frame along the latch side of the door as well as corner points on the door and frame that are out of registration.

Generally such problems are currently corrected by shimming a hinge or two with a cut piece of cardboard, thin flooring scrap, or in some cases a shim cut out to fit behind of the hinge in its mount to the door or the frame mounting surface. Testing for correct fit between the door and frame is accomplished by closing the door and checking the gaps. If the door sticks at the top hinge, it may be rectified by shimming the top hinge and snugging the bottom hinge, and vice versa for a door sticking at the bottom hinge. If the door sticks at the top knob-side corner, tightening the top hinge and shimming the bottom hinge will generally solve the problem, and vice versa for a door sticking at the bottom knob-side corner.

Unfortunately the science and application of shimming is at best, inexact, in that it is a trial and error procedure. Too much of a shim will cause a problem with the door mount opposite of the original fit. Too little of a shim will fail to correct the problem as intended. Consequently the correct fit of a door in the intended frame tends to be a time consuming and frustrating process requiring the repeated removing of the hinge across from the gap which needs to be closed or relieved and placing the shim in the mortise and reattach the hinge over it. On each such adjustment the person mounting the door must visually note how much the door gap changed and re-shim the hinge just adjusted or shim other hinges accordingly if necessary. A further vexing problem of this inexact science is the fact that shimming out too thick will often make the shim visible which is not a desirable trait in most situations where doors are mounted, especially in the home where visual cleanliness is valued.

Additional problems with the fit and easy rotation of doors on their hinges are caused in older buildings or door installations. In such instances the door frames may tend to be out of square from the setting of the building on its foundation, or the swelling or shrinking of the frame over time from moisture and humidity affecting the frame itself. On such a retrofit project, removing the screws mounting the hinges to the frame or the door can be a pursuit fraught with peril, in that stripping of the screw within its mount in the door or frame will cause the additional problem that must be corrected. Consequently the removal of screws from hinges on older installations to allow for shimming of the hinge mounts is not a desirable task and each such removal and installation of the mounting screws creates the potential for a stripped screw mounting and additional problem.

As such, a device that would alleviate the need for shimming on newly mounted doors and doors that have been installed in frames for many years would be especially useful. Such a device would also alleviate the potential for stripping the mount of the screws to the door or frame from the repeated removal and reinstallation of the screws when shim adjustments are required. Such a device should be easily adjustable therefore without the need to remove any of the screws or similar means of attachment of the hinge members to the door or frame, yet be visually attractive due to the nature of most door installations being in the home or business environment where aesthetic qualities are valued as much as mechanical performance.

U.S. Pat. No. 3,870,361 (Krause ) addresses the need for adjusting the door in its frame mounting by the use of adjustable bushings, however Krause is a complicated device intended to support an automobile door welded thereto and must be mounted in a large hollow between a car door and frame to function. It would not function as a door mount in a typical home or office and lacks the ability for easy adjustment afforded by Applicant's device.

U.S. Pat. No. 4,494,275 (Hsi-Shan) also addresses the need for a hinge providing adjustment, however Hsi-Shan uses a complicated arrangement of dual rotating eccentrics and ball bearings which increase cost and which are not easily user adjustable when the door is mounted.

U.S. Pat. No. 5,689,855 (Tang) teaches a device for the provision of adjustment of doors within their frames. Tang, however depicts hinges that attach to the top and bottom edges of a conventional door and would not be useable with the vast majority of entry doors for the residential and commercial rooms and buildings. Tang also places the majority of weight on the adjustable busing when mounted which would inhibit easy adjustment.

GB patent 2230557B (Briggs) discloses a two-piece hinge that is adjustable for lateral translation of the door in the frame, however Briggs supports the weight of the hung door on the bushings providing the adjustment and renders adjustment difficult if not impossible to adjust the hinges and attached door for location should the weight of the door jam the bushing. This is especially prevalent in older doors that have been hanging for years and which tend to sag under the constant pull of gravity.

As such, there exists a need for an easily and inexpensively manufactured hinge that will function with conventional entry doors and provide adjustment of such doors inside their frames. Such a hinge should provide for easy adjustment of both newly hung doors and doors having been hanging for many years. Such a device should be easy to mechanically adjust from the exterior of the hinge and should bear the majority of weight of the hung door in such a manner so as not to bind the adjustment components when the door weight is imparted to the hinge.

SUMMARY OF THE INVENTION

Applicants' device is an easily manufactured and installed hinge featuring a pair of rotationally engageable hinge members which are cooperatively attached using a pair of weight bearing hinge bushings and a pair of body bushes each having an off center bore therethrough which is shaped cooperatively engage and rotate with, the exterior of an axial hinge pin. The hinge pin engages with the hinge bushings at both ends at the center point of the hinge bushings thereby forming a central axis therebetween when the hinge is assembled with the hinge bushings, body bushings, and hinge pin in operative engagement.

Adjustability of the hinge is provided by rotation of the body bushes having the off center bore therethrough in their slidable engaged mount with a passage in the second hinge member. The bore is shaped in such a fashion as to cooperatively engage the exterior of the hinge pin that passes through both body bushes. The hinge pin is attached to the hinge bushings at both ends with at least one of the hinge bushings having a tool engageable slot in a side which exposed when the hinge is assembled. Inserting the cooperating tool into the tool engageable slot and rotating the hinge pin will thus cause both of the body bushings to rotate in their engagement with the boss of one of the hinge members. As the central bore of both body bushings is off center, an eccentric is created such that the hinge member engaging the exterior of the body bushings laterally translates toward or away from the center axis extending between the hinge bushings and does so at a plurality of angles.

An object of this invention is to provide for a hinge that is easily adjustable hinge which will allow for the alignment and adjustment of hung doors in their frames.

Another object of this invention is to provide such an adjustable hinge that will maintain an easy mechanical adjustment when the door weight is applied to the hinge by focusing the majority of weight born by the hinge to avoid binding of the adjustable components.

A further object of this invention is the provision of a hinge that is easily adjustable by a user by the provision of easily accessible tool engageable adjustment slots.

Further objects of the invention will be brought out in the following part of the specification, wherein detailed description is for the purpose of fully disclosing the invention without placing limitations thereon.

BRIEF DESCRIPTION OF DRAWING FIGURES

FIG. 1 is a perspective view of the disclosed device showing an exploded view of the two rotationally engageable hinge members and components therein.

FIG. 2 is a top view showing the tool engageable adjustment slot which is accessible when the door is mounted.

FIG. 3 is a cut away end view of the body bushings with offset bores shaped to cooperatively engage the hinge pin.

FIG. 4 is a side view of the disclosed device in a mounted position showing the assembled hinge members and slots for set screws to engage and maintain the positions of the body bushings.

DETAILED DESCRIPTION OF THE PREFERRED EMBODIMENTS OF THE INVENTION

Referring now to the drawing Figures, specifically FIGS. 1 through 4, depict preferred embodiments of the invention herein disclosed and the operation thereof.

FIG. 1 depicts an exploded view of the hinge device 10 showing a first hinge member 12 which is rotationally engageable for relative pivotal movement with a second hinge member 14. The first hinge member 12 is best formed from metal sufficient in strength to support the intended door and is connectable to a mounting surface using a means of attachment of the first hinge member 12 to such a mounting surface which in the current best mode features a plurality of mounting apertures 16 extending through a substantially flat base portion and sized to accommodate conventional screws 18 which would engage the door frame or other mounting surface.

A pair of mounting shoulders 20 communicate with and extend from the relatively flat base portion 19 of said first hinge member 12. Each mounting shoulder 20 has a bushing aperture 22 communicating therethrough with both of the bushing apertures 22 being substantially inline and on the same center axis 24. The second hinge member 14 features a central shoulder 26 with shoulder passageway 28 running axially therethrough about a shoulder center axis 30. In each end of the central passageway 28 a body bushing 32 is rotationally mounted which has an exterior circumference surface 33 configured to slidably engage with the interior surface 29 of the passageway 28. Both body bushings 32 have an off center bore 34 communicating axially therethrough off of the center axis running through the body bushing 32.

The hinge pin 36 features an upper hinge bushing 38 attached at a first end which in the current best mode is of unitary construction or permanent attachment of the hinge pin 36 to the upper hinge bushing 38. Cooperative operative engagement of the first hinge member 12 to the second hinge member 14 is accomplished with the central shoulder 26 positioned between the mounting shoulders 20 and the insertion of the hinge pin 36 down the first hinge member center axis 24 to engagement at its distal end with a bore in the lower hinge bushing 40. Also engaging the hinge pin 36 are the pair of substantially equal sized body bushes 32 each having an off-center bore 34 communicating therethrough. The off center bore 34 is shaped to cooperatively engage a similarly shaped exterior of circumference of the hinge pin 36 which as currently depicted is in the shape of an Allen wrench. The hinge pin 36 in this manner mechanically engages the bore 34 in both body bushes 32 which are located at both ends of the passageway 28 in the central shoulder 26. As is shown, the exterior circumference of the body bushings 32 are dimensioned to slidably engage the wall surface 29 of the passageway 28 in the central shoulder 26 thereby allowing them to rotate in the passageway 28 when the hinge pin 36 is rotated.

In the assembled configuration, a portion of the weight and force of the hung door is imparted to the two end surfaces 44 of the central shoulder 26 upon the substantially parallel interior sidewalls 46 on the mounting shoulders 20. In the current best mode, an optional but preferable washer type spacer 37 providing a bearing surface especially if the spacer 37 is of a plastic or other material such as Teflon, will provide an easy surface for rotation thereon. The washer type spacer 37 can also be formed onto one end of the body bushes 32 as a shoulder portion of the body bushes 32 slightly larger than the diameter thereof, in a unitary structure to yield the spacer 37 and body bush 32 in a single unit which would have an appearance similar to that of the upper and lower hinge bushings 38.

A substantial portion of the door weight is naturally supported by the exterior surface of the upper hinge bushing 38 and lower hinge bushing 40 on the interior surface of the bushing aperture 22 since the elongated hinge pin 36 functions much like a lever which imparts the most force to the outside ends of the hinge bushings 38 and 40. This force is sufficient to prevent unintended rotation of the upper hinge bushing 38 and lower hinge bushing 40 in their mounts with the shoulders 20 but naturally not enough to bind this engagement. As a consequence of this weight bearing arrangement the rotation of the body bushings 32 with their off center bore 34, using the tool inserted into the engageable slot 48, is substantially unimpaired even when the spacer 37 is formed on one end of the body bushing 32 in the aforementioned arrangement. This allows them to rotate easily when the hinge pin 36 is rotated by the user. This rotation is accomplished using a tool dimensioned to cooperatively engage a tool engageable slot 48 formed into the upper hinge bushing 38 on a side surface which remains exposed when the hinge device 10 is assembled. A protective end cap 50 can thereafter be removably engaged with a cooperatively dimensioned cap cavity 52 formed into the upper and lower edges of the mounting shoulders 20. The end cap 50 in this fashion is frictionally engaged with the cap cavity 52 to provide an aesthetically pleasing exterior surface to the device 10, to provide a means to further secure the hinge pin 36 in place, and can be thereafter temporarily removed to allow tool insertion into the tool slot 48 for adjustment.

Adjustability of the hinge device 10 is accomplished in a simple fashion by rotation of the body bushes 32 by rotating the hinge pin 36 which is operatively engaged with the off center bore 34 communicating through both body bushes 32. Because the bore 34 is off center, an eccentric is formed by the rotation of the body bushes 32 inside the passageway 28 of the central shoulder 26 since the exterior surface of the body bushes 32 slidably communicate with the interior surface of the passageway 28.

Rotating the body bushes 32 in this fashion will translate the position of the center axis 30 of the center bore 34 and thus the second hinge member 14 around and relative to the first center axis 24 of first hinge member 12 thereby providing translation of the second hinge member 14 toward or away from and around the center axis 24 along a path around the center axis 24 determined by the distance of the bore 34 is located from the center axis 30 running through both body bushes 32 when rotationally mounted. If therefore a slightly different amount of adjustment was desired in the lower hinge on a two hinge-mounted door, the distance of the center bore 34 from the center axis 30 might be slightly more or less than that of the upper hinge, thereby allowing more adjustability. A kit featuring a plurality of different body bushes 32 with bores at differing distances from the center axis 30 could be provided allowing the user to choose the best body bush 32 for the job.

The translating of the second hinge member 14 around the center axis 24 of the first hinge member 12 thereby also translates the door attached to the second hinge member 14 inside the frame thus allowing an adjustment of the opposite door edge where the door handle would be with the adjacent door jam edge as well as the interior and exterior door surfaces with their contact with the stop in the door frame.

Using the eccentric means provided by the combination of the body bushes 32 rotating on the hinge pin 36 on the center axis 24 running through the passageway 28 of the central shoulder 26 of the assembled device 10 the user can independently adjust all of the hinges holding a door onto a wall or door frame surface to accommodate a non square frame or door as well as doors which may have sagged after long use. Once proper alignment of the attached door with the intended frame is achieved by rotating the hinge pin 36 to activate the eccentric means to properly position the door, screws 53 cooperatively communicating through the mounting shoulders 20 with the bushing aperture 22 adjacent to the upper hinge bushing 38 and lower hinge busing 40. The set screws 53 may be tightened against the surface of the hinge pin 36 to thereby provide a means to prevent rotation of the hinge pin 36 thus locking it in the desired position to yield the desired lateral translation of the attached door.

As noted above, mounting of the device 10 is provided by a plurality of mounting apertures 16 communicating through the first hinge member 12 sized to accommodate screws 18 or other means of affixing the device 10 to a mounting surface. The second hinge member 14 is attached to the intended door in the same fashion using a plurality of such mounting apertures 16 sized to accommodate the appropriate screw 18.

While all of the fundamental characteristics and features of the Adjustable Hinge herein disclosed have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A hinge apparatus for cooperative engagement with a door and mounting surface for said hinge apparatus, comprising:

a first hinge member, said first hinge member having a first end and a second end and having a substantially flat mount surface;

means of attachment of said first hinge member to said mounting surface;

a first mounting shoulder at said first end of said first hinge member having a first bushing aperture communicating therethrough between a substantially flat inner side surface and an exterior side surface, said inner side surface and said exterior side surface substantially normal to said mount surface;

a second mounting shoulder at said second end of said first hinge member having a second bushing aperture communicating therethrough between a substantially flat inner side surface and an exterior side surface, said inner side surface and said exterior side surface of said second mounting shoulder being substantially normal to said mount surface;

a mounting gap formed between said flat inner surface of said first mounting shoulder and said flat inner surface of said second mounting shoulder;

a first center axis substantially parallel to said mounting surface, said first center axis communicating axially through the center of each of said first and second bushing apertures;

a second hinge member having a substantially flat attachment surface;

means of attachment of said second hinge member to a door;

said second hinge member having a central shoulder portion, said central shoulder being of a length slightly smaller than said mounting gap and having an elongated round passageway communicating therethrough between two substantially flat shoulder end surfaces, said passageway having a passageway center axis substantially parallel to said attachment surface;

said second hinge member locateable to a mounted position with said central shoulder portion in said mounting gap, said shoulder end surfaces being substantially normal to said mount surface when said central shoulder is positioned in said mounting gap;

a hinge pin, said hinge pin having a first end and a second end, and an exterior surface;

a cylindrical upper hinge bushing having an interior side and exterior side and a exterior circumference surface distanced from a centerline extending axially therethrough, said upper hinge bushing attached to said first end of said hinge pin at said centerline on said interior side, said circumference surface dimensioned to rotationally engage within said first bushing aperture;

a cylindrical lower hinge bushing having a center axis therethrough and dimensioned for rotational engagement within said second bushing aperture, said lower hinge bushing having an upper side edge, said upper side edge having a pin aperture formed therein at said center axis, to engage the exterior surface of said hinge pin at said second end of said hinge pin;

a pair of cylindrical body bushings, said body bushings having a bushing center axis and an exterior sidewall surface spaced from said bushing center axis a distance to allow said exterior sidewall surface to rotationally engage within said passageway;

each of said body bushings having a bore communicating axially therethrough, said bore being parallel to said bushing center axis of said body bushings and positioned off center from said bushing center axis between said center axis of said body bushings and said side wall surface of said body bushings, said bore shaped to cooperatively engage the shape of said exterior surface of said hinge pin traversing therethrough;

said hinge pin having a mounted position wherein said hinge pin is located along said first center axis with said first end attached to said upper hinge bushing when rotationally engaged with said first bushing aperture, and with said second end engaged with said pin aperture when said lower hinge bushing is rotationally engaged within said second bushing aperture, and with said hinge pin cooperatively engaged with and communicating through said bore in each of said body bushings when said body bushings are rotationally engaged in said passageway;

means to rotate said hinge pin and said body bushings cooperatively engaged therewith, when in said mounted position;

said second hinge member passageway center axis translateable in a path around said first center axis to a determined position, by rotation of said hinge pin cooperatively engaged through said bore in each of said body bushings; and means to maintain said hinge pin in said determined position.

2. The hinge apparatus of claim 1 wherein said means to maintain said hinge pin in said determined position comprises:

at least one set screw cooperatively engaged in a screw aperture communicating through one of said upper mounting shoulder or lower mounting shoulder, said set screw adjustable to a position in communicating with said hinge pin to frictionally engage said hinge pin and hold it in said determined position.

3. The hinge apparatus of claim 1 wherein said means to rotate said hinge pin comprises said upper hinge bushing having a tool engagement slot formed into said exterior side, said tool engagement slot engageable with a tool configured for cooperative engagement therewith which when inserted and rotated will rotate said hinge pin.

4. The hinge apparatus of claim 1 wherein said means of attachment of said first hinge member to said mounting surface comprises:

said mount surface having a plurality of mounting passages communicating therethrough; and screws affixable through said mounting passages into said mounting surface.

5. The hinge apparatus of claim 1 wherein said means of attachment of said second hinge member to a door comprises:

said attachment surface having screw apertures communicating therethrough; and screws affixable through said screw apertures into said door.

6. The hinge apparatus of claim 1 additionally comprising a pair of end caps cooperatively engageable with end cap cavities formed into said exterior side surface of said first mounting shoulder and in said exterior side surface of said second mounting shoulder.

7. The hinge apparatus of claim 1 additionally comprising said pair of cylindrical body bushings selectable from a kit of said cylindrical body bushings, said kit having a plurality of different body bushings having said bore a different distance from said center axis.

* * * * *